US006561112B1

(12) United States Patent
Benson et al.

(10) Patent No.: US 6,561,112 B1
(45) Date of Patent: May 13, 2003

(54) SYSTEM AND METHOD FOR A MOTION COMPENSATED MOON POOL SUBMERGED PLATFORM

(76) Inventors: Dan T. Benson, 15418 Winterhaven, Tomball, TX (US) 77375; James R. Reaux, 2230 Apache La., Brookshire, TX (US) 77423

( * ) Notice: Subject to any disclaimer, the term of this patent is extended or adjusted under 35 U.S.C. 154(b) by 0 days.

(21) Appl. No.: 10/127,250

(22) Filed: Apr. 22, 2002

(51) Int. Cl.[7] ..... B63B 21/00
(52) U.S. Cl. ..... 114/230.1; 441/3
(58) Field of Search ..... 441/3–5; 114/230.1, 114/230.12, 230.13, 264

(56) References Cited

U.S. PATENT DOCUMENTS

| | | | | |
|---|---|---|---|---|
| 4,099,560 | A | 7/1978 | Fischer et al. | |
| 4,200,054 | A | 4/1980 | Elliston | |
| 4,232,903 | A | 11/1980 | Welling et al. | |
| 4,281,615 | A | 8/1981 | Wilson et al. | |
| 4,324,194 | A | 4/1982 | Elliston | |
| 4,425,055 | A | 1/1984 | Tiedemann | |
| 4,471,708 | A | 9/1984 | Wilson et al. | |
| 4,537,533 | A | 8/1985 | Hampton | |
| 4,646,672 | A | 3/1987 | Bennett et al. | |
| 4,666,341 | A | 5/1987 | Field et al. | |
| 5,237,946 | A * | 8/1993 | Copson | 114/27 |
| 5,927,224 | A | 7/1999 | Etheridge et al. | |
| 6,000,480 | A | 12/1999 | Eik | |
| 6,009,820 | A | 1/2000 | Kellog et al. | |
| 6,047,781 | A * | 4/2000 | Scott et al. | 175/5 |
| 6,056,071 | A | 5/2000 | Scott et al. | |
| 6,068,069 | A | 5/2000 | Scott et al. | |
| 6,085,851 | A | 7/2000 | Scott et al. | |
| 6,227,137 | B1 | 5/2001 | Allen et al. | |
| 6,244,785 | B1 | 6/2001 | Richter et al. | |
| 6,257,165 | B1 | 7/2001 | Danos, Jr. et al. | |
| 6,260,502 | B1 | 7/2001 | Kratz et al. | |
| 6,263,818 | B1 | 7/2001 | Dietens et al. | |
| 6,268,557 | B1 | 7/2001 | Devecka | |
| 6,273,193 | B1 | 8/2001 | Hermann et al. | |

* cited by examiner

*Primary Examiner*—Stephen Avila
(74) *Attorney, Agent, or Firm*—Duane Morris LLP

(57) ABSTRACT

A moon pool platform containment system is disclosed for a vessel comprising a first moon pool having a width, length, and depth, to aid in stabilizing moon pool platform motion to achieve a motion compensated moon pool submerged platform, the moon pool platform containment system a platform having a predetermined opening therethrough, the opening defining a second moon pool, the platform being sized smaller than the width and length of the first moon pool; at least one leg connected to the platform, the leg having a predetermined length; a source of leveling material; and a chamber in communication with the source of leveling material via a leveling material conduit. Leveling material may be supplied to or transferred from the chamber to supply positive or negative floatation as dictated by forces on the platform. It is emphasized that this abstract is provided to comply with the rules requiring an abstract which will allow a searcher or other reader to quickly ascertain the subject matter of the technical disclosure. It is submitted with the understanding that it will not be used to interpret or limit the scope of meaning of the claims.

22 Claims, 1 Drawing Sheet

SYSTEM AND METHOD FOR A MOTION COMPENSATED MOON POOL SUBMERGED PLATFORM

FIELD OF THE INVENTION

The present invention relates to the field of vessels. More specifically, the present invention, in an exemplary embodiment, relates to a system for and method of operation of an independent moon pool platform deployed in a vessel with its own moon pool where the motion of the independent moon pool platform is compensated with respect to motion of the vessel.

BACKGROUND OF THE INVENTION

A moon pool, as will be familiar to those in the vessel arts, is a shaft or opening in a vessel that extends through the vessel, allowing access to water in which the vessel is afloat. Typically, a moon pool is a large opening through-the vessel's deck that continues through the bottom of the vessel and is located about midship to accommodate drilling operations.

It is well known that ship-adapted drilling units are very susceptible to wave action and will tend to move in a direct relationship with the encountered sea state. In the prior art, it is also known that water in the moon pool does not stay at mean sea level. It is not uncommon for columns of water extending over ten feet come through the moon pool, even when seas are less than ten feet. This is especially common in intervention, or smaller, vessels.

U.S. Pat. No. 6,244,785 issued to Richter, et al. for "Precast, modular spar system" is illustrative of prior art moon pool designs. Richter teaches a precast, modular spar system having a moon pool open at the bottom and containing water non-excited by waves centrally extending the entire length of the spar and defined by inner radial walls of sections of the spar.

BRIEF DESCRIPTION OF THE DRAWINGS

The features, aspects, and advantages of the present invention will become more fully apparent from the following description, appended claims, and accompanying drawings in which:

DETAILED DESCRIPTION OF THE PREFERRED EMBODIMENT

Figure 1:
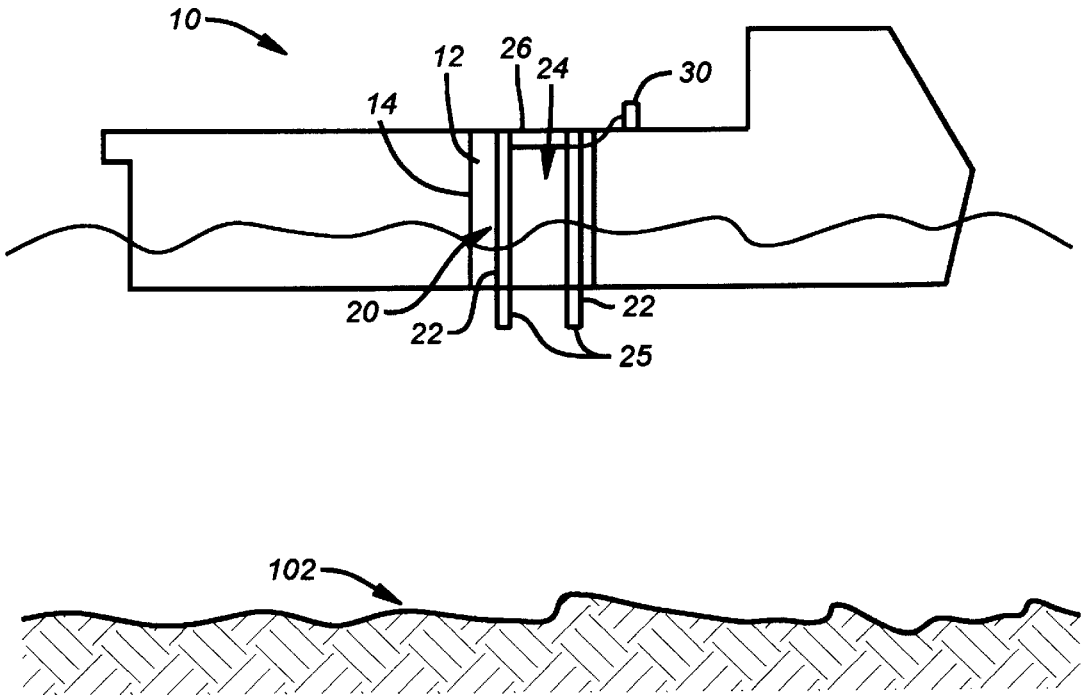
FIG. 1 is a a partial cutaway, perspective plan view showing a vessel with a moon pool and an inner vessel deployed within the moon pool.

Referring now to FIG. 1, the system for and method of the present invention disclose moon pool containment system 20 for parent vessels 10 with moon pools 12. As used herein, the terms "moon pool platform containment system" and "inner vessel" are equivalent. As further used herein, "leveling material" refers to both ballast and buoyancy materials which may be used either singly or in combination, and "level" refers to addition or deletion of either ballast or buoyancy materials.

Inner vessel 20 comprises platform 26 having a void therethrough defining second moon pool 24; one or more legs 22 connected to platform 26, each leg having a predetermined length; and leveling material 32 (not shown in the figures) in communication with at least one chamber 25. Chamber 25 may be internal or external to one or more legs 22. For plurality of chambers 25, leveling material conduit 23 (shown in FIG. 2) may be present and in fluid communication between at least two of the plurality of chambers 25. The rate of change of buoyant forces on inner vessel 20 relative to wave action is minimized.

The center of buoyancy of inner vessel 20 may be submerged to a depth such that wave action of the ocean will not affect motion. Accordingly, inner vessel 20 may be used to deploy objects to and recover objects from sea floor 102 without concern about the motion of parent vessel 10 or of the ocean itself.

Figure 2:
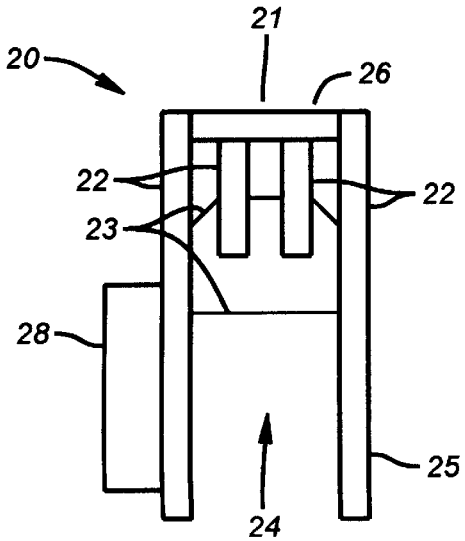
FIG. 2 is a partial perspective plan view of an embodiment of the inner vessel of the present invention.

Referring now to FIG. 2, platform 26 may be substantially rectangular or may be a shape as required by a parent vessel, e.g. circular, trapezoidal, or customized to a given shape. Platform 26 further comprises opening 21 to allow access to moon pool 24.

Legs 22 are connected to platform 26. In a preferred embodiment, legs are removably connected to platform 26 to allow onboard assembly and disassembly of inner vessel 10. One or more legs 22 may be tubular and may further comprise chamber 25. Although four legs 22 are depicted in FIG. 2, multiple configurations of legs 22 may be used. Legs 22 extend downward such that, when deployed within moon pool 12 (FIG. 1), legs 22 will extend to a predetermined depth below sea level.

In a preferred embodiment, each leg 22 comprises one or more chambers 25 that may be filled with or emptied of leveling material 32. Chamber 25 may be internal to leg 22, external to leg 22 such as at 28, or a combination thereof. Accordingly, leg 22 may be open at its top and closed at its submerged end, open at its submerged end and closed at its top, open at both ends, or substantially solid. If substantially solid, leg 22 will further comprise an external chamber 28, although external chamber 28 may be present irrespective of the configuration of leg 22. In a currently envisioned alternative embodiment, external chamber 28 is located subsea.

Leveling material 32 may be used to trim inner vessel 20. Leveling material 32 may comprise fluids, solids, or the like, or a combination thereof. In open top configurations, leveling material 32 may be supplied to chamber 25 through the open top or a port in a lid in communication with the open top. In closed top configurations, leveling material 32 may be supplied to chamber 25 through a port in the closed top such as a valve fluid port. In alternative embodiments, leveling material 32 may be supplied to chamber 25 through transfer between chambers 25, from either another chamber 25 or from a source 30 of leveling material 32, to supply positive or negative floatation as dictated by forces on inner vessel 10.

Platform 26 and legs 22 may comprise any material suitable for ocean use that can support a predetermined load, by way of example and not limitation including metals such as A36 or 572 grade steel. In addition, the material may be coated for use in ocean environments.

Buffer 40 (not shown in the figures) may be deployed at predetermined positions about platform 26, inner hull 14 of moon pool 12, or a combination thereof to protect parent vessel 10 and inner vessel 20 by absorbing impacts when relative movements of parent vessel 10 and inner vessel 20 may cause parent vessel 10 and inner vessel 20 to physically impact on each other. Buffer 40 may be a rail system, a roller system, cushioning material such as rubber tires, or the like, or combinations thereof, as these terms will be familiar to those of ordinary skill in the vessel construction arts.

Figure 3:
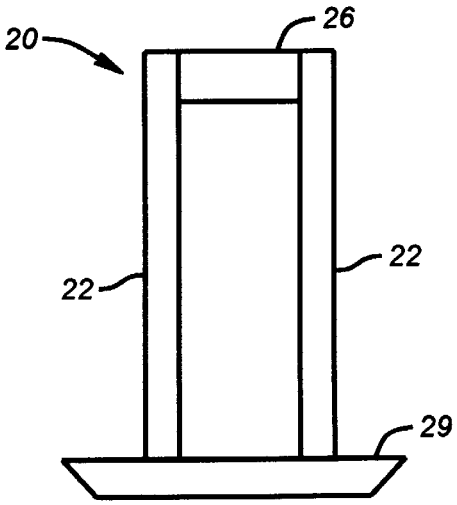
FIG. 3 is a partial perspective plan view of an embodiment of the inner vessel of the present invention with a schematic view of an active compensation system.

Referring now to FIG. 3, in a currently preferred embodiment, loads acting on platform 20 act in conjunction with leveling material 32 to provide a passively heave compensated system for deployment within moon pool 12 of parent vessel 10. In a currently envisioned alternative, transfer of leveling materials 32 may be effected such as through computer controlled valves 60 operatively connected to leveling material controller 61. In this embodiment, valves 60 are preferably fast acting, three way valves. Leveling material controller 61 may be an electric, hydraulic, or electro-hydraulic pump.

Computer 62 may be used to automate the transfer such as in combination with motion reference unit 64. In systems using computer 62 and/or MRU 64, active compensation for pitch and roll may effected.

In preferred embodiments, inner vessel 10 comprises a spar configuration such as shown in FIG. 1, FIG. 2, and FIG. 3 and leveling is used to keep inner vessel 10 in trim. In a currently envisioned alternative embodiment, inner vessel 10 may further comprise lower attachment 29 attached to legs 22. Lower attachment 29 may be a keel of a traditional kind as will be understood by those of ordinary skill in the vessel making arts.

In the operation of an exemplary embodiment, inner vessel 10 is deployed within moon pool 12. Inner vessel 10 may be disassembled and reassembled onboard vessel 10.

Inner vessel 20 defines its own moon pool 24. When deployed in vessel moon pool 12, inner vessel 10 may be vented or filled with leveling material 32, thus supplying positive or negative floatation as dictated by the forces on inner vessel 20 and providing a passively heave compensated system for deployment within moon pool 12.

Accordingly, when vented, inner vessel 10 will retract against inner hull 14 of moon pool 12 to facilitate transport of inner vessel 10. When partially submerged, inner vessel 20 will be in a working position and the leveling may be adjusted according to the deckload and working load of inner vessel 20.

In typical situations, inner vessel 20 will be fixed in coordinate space, relative to ocean floor 102, with minimal heave due to wave action, sea level, or friction between inner vessel 20 and moon pool 12 of parent vessel 10.

By way of example and not limitation, using movement of leveling material 32 within chambers 25, inner vessel 20 may additionally compensate for pitch or roll such as that caused by wave action, sea level, or friction between inner vessel 20 and vessel 10. The length of legs 22 may be used as a factor in determining the amount of roll and pitch that inner vessel 20 will accommodate.

Forces to be passively compensated may be generated external to inner vessel 20 such as from the weight of a mass on platform 26 or forces arising from use of equipment during downhole wireline operations. Additionally, active compensation, if present, need not be full time. In typical situations, active compensation is only needed when parent vessel 10 is attached to a downhole tool or landing a subsurface lubricator (not shown in the figures).

By way of example and not limitation, during pipeline welding operations, inner vessel 20 may be used prior to the welded pipeline being laid onto to seafloor 102. During these operations, it is important that inner vessel 20 compensate for the weight of the submerged pipe as a deviation in angle on a line from bow to stern of the vessel may affect the welded pipeline.

Forces may also be anticipated so that corrective, offsetting action can be taken prior to the anticipated action. By way of example and not limitation, leveling material 32, e.g. fluid or weight, may be moved under computer control between source 30 and/or chambers 25 by using material leveling controllers such as electric, hydraulic, or electro-hydraulic pumps 61.

During temporary abandonment, inner vessel 20 may be submerged, by way of example and not limitation by reeling in one or more bottom-anchored cables via winches attached to inner vessel 20. After submergence to a predetermined depth, parent vessel 10 may proceed to another destination. Inner vessel will remained moored below the ocean surface.

It will be understood that various changes in the details, materials, and arrangements of the parts which have been described and illustrated above in order to explain the nature of this invention may be made by those skilled in the art without departing from the principle and scope of the invention as recited in the following claims.

We claim:

1. A moon pool platform containment system for a parent vessel, the parent vessel comprising a first moon pool having a width, length, and depth, the moon pool platform containment system comprising:

a. a platform having a predetermined opening therethrough, the opening defining a second moon pool, the platform being sized smaller than the width and length of the first moon pool;

b. at least one leg connected to the platform, the leg having a predetermined length;

c. a source of leveling material; and d. a chamber in communication with the source of leveling material via a leveling material conduit.

2. The moon pool platform containment system of claim 1 wherein the chamber is at least one of a chamber internal to the at least one leg and a chamber external to the at least one leg.

3. The moon pool platform containment system of claim 1 wherein the leveling material may be supplied to the chamber to supply positive or negative floatation as dictated by forces on the platform.

4. The moon pool platform containment system of claim 1 wherein the leveling material comprises at least one of fluids and solids.

5. The moon pool platform containment system of claim 1 further comprising a programmable active compensation system wherein transfer of leveling material to the chamber is effected by the programmable active compensation system according to predetermined control programming.

6. The moon pool platform containment system of claim 1 wherein the at least one leg is a plurality of legs.

7. The moon pool platform containment system of claim 1 wherein:

a. the at least one leg is a plurality of legs, a second plurality of which each further comprises a chamber; and b. the leveling material conduit is at least partially in fluid communication between the plurality of chambers.

8. The moon pool platform containment system of claim 7 wherein the leveling material supplied to one of the plurality of chambers is provided from at least one of a source of leveling material or another chamber.

9. The moon pool platform containment system of claim 8 further comprising a programmable active compensation system wherein transfer of leveling material to a chamber is effected by the programmable active compensation system according to predetermined control programming.

10. The moon pool platform containment system of claim 9 further comprising valves disposed intermediate the chambers through which leveling material is transferred between the chambers.

11. The moon pool platform containment system of claim 1 further comprising a buffer attached to at least one of the platform or an inner surface of the first moon pool to absorb impacts between the platform and the inner surface of the first moon pool.

12. The moon pool platform containment system of claim 1 wherein the platform further comprises a support for a predetermined slickline unit capable of performing in an open sea.

13. The moon pool platform containment system of claim 12 wherein the slickline unit comprises at least one of a riserless unit and a wireline intervention unit.

14. The moon pool platformn containment system of claim 1 wherein the platformn and legs are of a predetermined mass sufficient to allow the moon pool platform containment system to be submerged to a predetermined depth.

15. The moon pool platformn containment system of claim 14 wherein the predetermined depth is such that wave action of the ocean will not affect mot ion of the moon pool platformn containment system.

16. A method of using a moon pool platform containment system of claim 1, comprising:

a. positioning the moon pool platform containment system within the first moon pool; and b. adjusting leveling material in the at least one leg to lower the moon pool platform containment system to a predetermined depth.

17. The method of claim 16 for a moon pool platform containment system further comprising a programmable active compensation system, further comprising:

a. anticipating active compensation counterforces using the programmable active compensation system;

b. calculating corrective, offsetting action by the programmable active compensation system; and c. adjusting the leveling materials in the chamber to effect the calculated corrective, offsetting action.

18. The method of claim 17 wherein, for step (c), the programmable active compensation system is operatively connected to a leveling material controller which automatically adjusts levels of the leveling materials in accordance to directives issued by the programmable active compensation system.

19. The method of claim 18 wherein the programmable active compensation system effects the adjusting using electric, hydraulic, or electro-hydraulic material leveling controllers.

20. A method of temporary abandonment of a moon pool platform containment system of claim 1, comprising submerging the moon pool platform containment system to a predetermined depth by reeling in a bottom-anchored cables via a winch attached to the moon pool platform containment system.

21. The method of claim 20, further comprising attaching a location buoy to the platform before leaving a vicinity of the platform.

22. The method of claim 16, further comprising:

a. assembling the moon pool platform containment system on board the parent vessel prior to positioning the moon pool platform containment system within the first moon pool; and b. disassembling the moon pool platform containment system on board the parent vessel prior after using the moon pool platform containment system.

* * * * *